US005337691A

United States Patent [19]

Borcherdt

[11] Patent Number: 5,337,691

[45] Date of Patent: Aug. 16, 1994

[54] MAST TRACK CLUTCH ASSEMBLY FOR SAILBOARDS

[75] Inventor: D. Thomas Borcherdt, Box 39D, R.R. #1, Tusket, Nova Scotia B0W 3M0, Canada

[73] Assignee: D. Thomas Borcherdt, Yarmouth, Canada

[21] Appl. No.: 107,570

[22] Filed: Aug. 18, 1993

[51] Int. Cl.[5] ..... B63B 35/72

[52] U.S. Cl. ..... 114/39.2; 114/93

[58] Field of Search ..... 114/39.2, 93, 102

[56] References Cited

U.S. PATENT DOCUMENTS 4,526,120 7/1985 Gaide ..... 114/93
4,579,074 4/1986 Camp et al. ..... 114/93
4,838,189 6/1989 Kurhi ..... 114/93

FOREIGN PATENT DOCUMENTS 258570 7/1988 Fed. Rep. of Germany ..... 114/93

*Primary Examiner*—Jesus D. Sotelo
*Attorney, Agent, or Firm*—R. Craig Armstrong

[57] ABSTRACT

A mast track clutch assembly allows the longitudinal position of the mast of a windsurfing sailing board to be adjusted by means of a foot pedal. The mast is attached to the clutch assembly, which is movable in a longitudinal track on the sailing board. The clutch assembly includes a pressure plate that is biased to retain the assembly at one position on the track. A foot pedal is operable to move the pressure plate against the bias, allowing the longitudinal position of the mast on the board to be adjusted by the board user while the board is in motion.

7 Claims, 3 Drawing Sheets

MAST TRACK CLUTCH ASSEMBLY FOR SAILBOARDS

This invention relates to a mast attachment assembly for attaching a mast to a sailboard, and more particularly, to a mast track clutch assembly for adjustable positioning of a mast longitudinally on a windsurfing board.

In the sport of windsurfing board sailing, specifically in the attachment of the mast to the board, it is a known advantage to be able to move the mast fore and aft on the board to adjust for different conditions. Nearly all of the small high-performance boards are equipped with a simple "T" slot in which resides a nut which may be tightened on a bolt extending from a rotatable base of the mast. In order to rotate the rotatable base, the board user gets off the board and, by rotating the base, loosens the nut in the "T" slot to allow the mast to slide. The base is then rotated in the opposite direction to tighten the nut on the bolt within the "T" slot, which fixes the base to the board at the desired longitudinal position.

U.S. Pat. No. 4,526,120, granted to Albert Gaide on Jul. 2, 1985, illustrates one type of mast base structure for a sailboard. The Gaide structure allows repositioning of the mast along a track on the sailboard while the user remains on the board. A cable line, extending partially through the mast, connects to a pressure plate normally biased to press against the track to prevent longitudinal movement of the mast relative to the sailboard. Pulling on the cable line allows longitudinal movement of the mast on the sailboard. The Gaide patent does not disclose a sail-board having either a simple "T" slot or a pedal actuation mechanism similar to that of the subject invention.

German Patent No. 29 45 624, granted on May 21, 1981 to Hannes Marker, discloses a mast base structure having a spring-loaded foot pedal that can be actuated to move a pin between holes longitudinally-spaced in the upper surface of a sailboard. Movement of the mast in this arrangement is limited to a set of discrete longitudinal positions corresponding to the hole placement. Also, the structure uses a unique track rather than the simple "T" slot found on wind-surfing boards.

U.K. Patent Application No. 2,008,053, published on May 31, 1979 listing Hannes Marker as applicant, discloses a mast base structure in which pins engage grooves to define a series of discrete longitudinal positions for the mast. This structure also uses a unique track rather than a "T" slot.

The mast track clutch assembly of the subject invention firstly comprises a stud member having one end adapted to extend into an internal longitudinally-extending slotted track on a sailboard, and the other end adapted to receive a mast. The assembly further comprises a fastener adjustably positionable on the stud member, and a housing that is slidably fitted on the stud member and positioned between the sailboard and the fastener. A plate is biased away from the housing to press against the surface of the sail-board to prevent movement of the clutch assembly relative to the sailboard. A pedal is pivotally mounted to the housing. The pedal has a first end extending outside of the housing and has a second end connected to the plate such that pressing the first end of the pedal acts against the bias to move the plate against the bias. The longitudinal position of the mast relative to the sailboard may be adjusted while the pedal is pressed.

The second end of the pedal may have a pair of forks which surround a pin mounted on the plate, or the pedal may be integrally connected with the plate such that the pedal and plate move together as a single unit. The clutch assembly may also comprise a roller means mounted on the housing to facilitate longitudinal repositioning of the mast relative to the sailboard when the pedal is pressed.

The stud member may be a threaded rod and the fastener may be a notched nut biased to assume one of a series of discrete angular positions relative to the housing. In this arrangement, a portion of the housing is adapted to extend into the slotted track to prevent relative rotation between the housing and the sailboard. The slotted track may be generally T-shaped and defined by a first slot extending generally parallel to the surface of the sailboard and a second slot extending generally normal to the surface between the surface and a central position on the first slot. In this arrangement, the stud member engages the slotted track by means of a second fastener positioned on the stud and adapted to sit in the first slot. The second fastener is sized to prevent the stud member moving out of the second slot. The stud member may be a threaded rod and the second fastener a nut, and the clutch assembly may also comprise a roller means mounted on the nut to facilitate longitudinal repositioning of the mast relative to the sailboard when the pedal is pressed.

The inventor has found that the pedal action of the subject invention allows the mast to be easily repositioned fore and aft on the sailboard without the board user having to get off the board or even stop the motion of the board. This offers a considerable advantage, especially during competitive manoeuvres necessary to achieve maximum efficiency in changing wind conditions.

The invention will next be more fully described by means of two preferred embodiments utilizing the accompanying drawings, in which.

Figure 1:
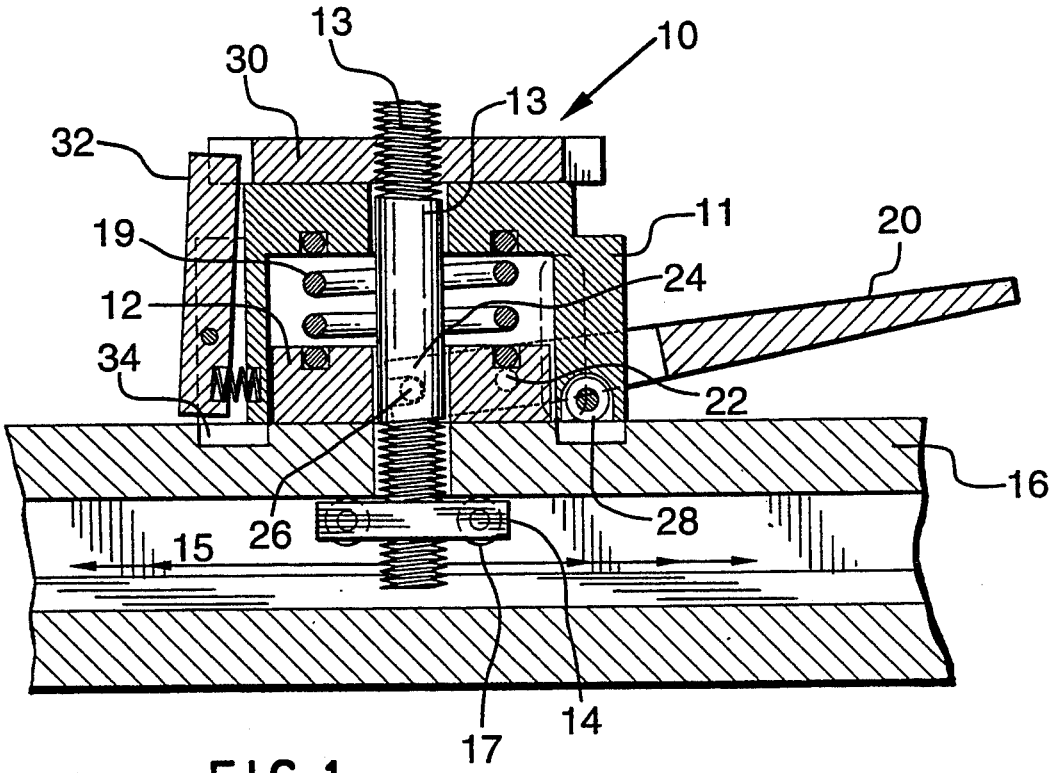
FIG. 1 is a partially-sectioned side view of a first embodiment of the mast track clutch assembly, the assembly being in the locked position on a sailboard.
Figure 2:
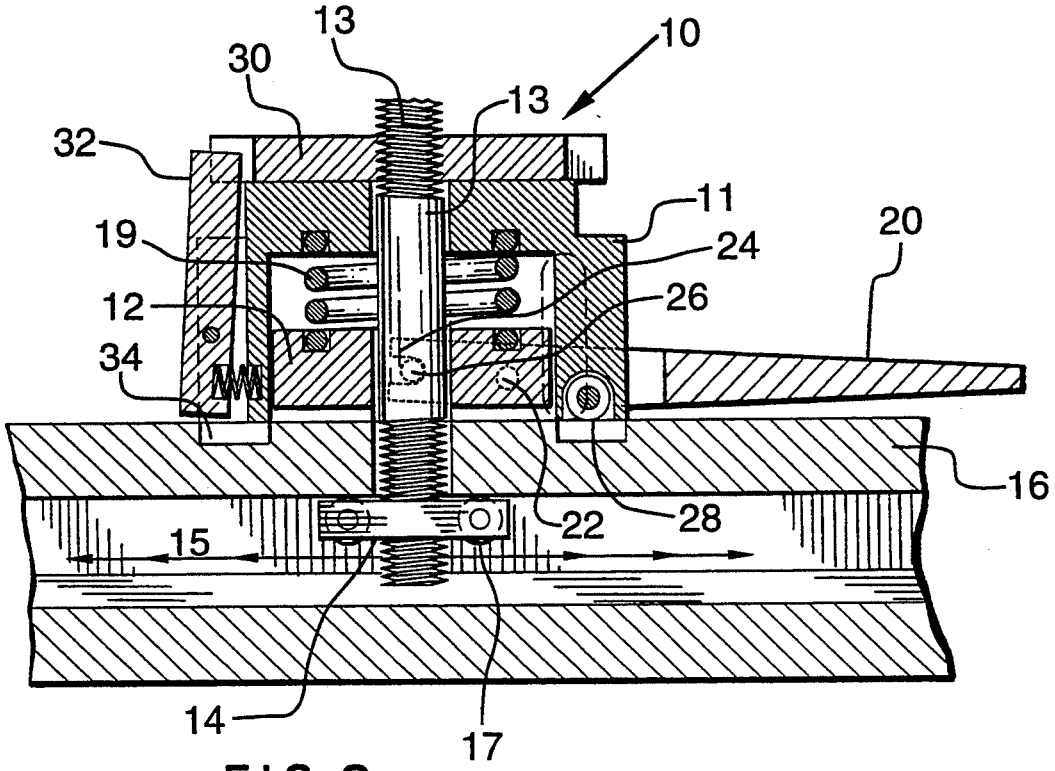
FIG. 2 is a partially-sectioned side view similar to that of FIG. 1, but showing the clutch assembly in its unlocked position on the sailboard.
Figure 3:
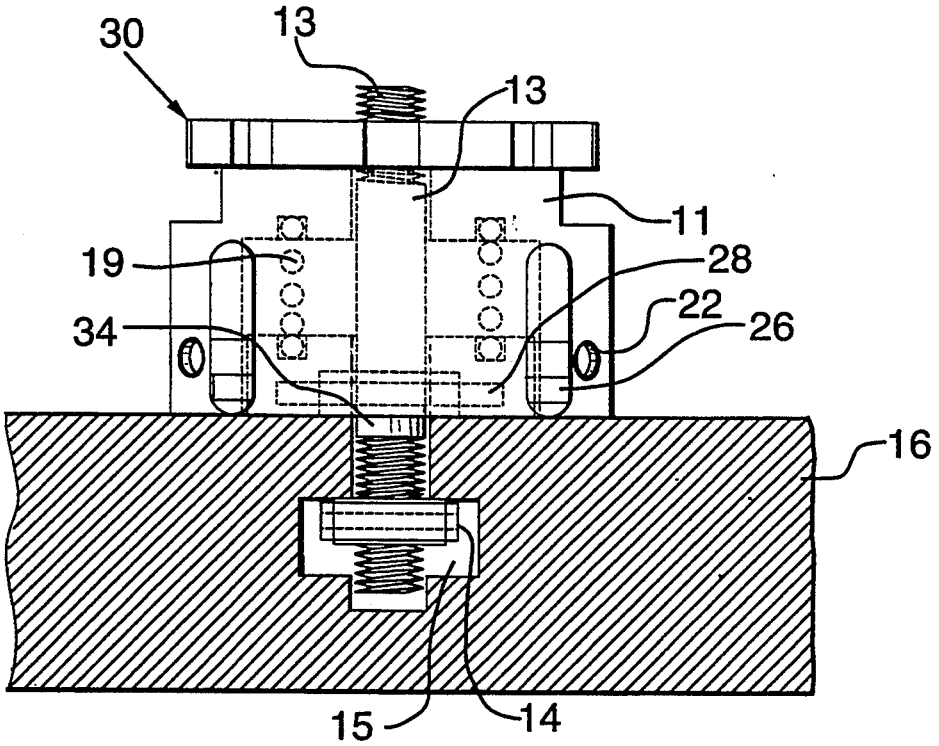
FIG. 3 is a partially-sectioned end view of the first embodiment of the clutch assembly, the view showing the assembly in the locked position on the sailboard.

A first embodiment of the clutch assembly, generally designated 10, comprises a housing 11 enclosing and guiding a pressure plate 12 freely movable on a stud 13. Stud 13 couples to a nut 14 below a T-shaped slot 15 on a board 16; nut 14 carries a pair of rollers 17. A compression spring 19 extending between housing 11 and pressure plate 12 presses that plate against the surface of board 16. A pedal 20, which rotates on a pin fulcrum 22 attached to the housing 11, is coupled to pressure plate 12 by means of forks 24 acting on opposing pins 26 that are fixed to the sides of plate 12.

Foot pressure on pedal 20 lifts pressure plate 12 and allows housing 11 to ride on a roller 28 and slide along the track 15. Rollers 17 on nut 14 allow clutch assembly 10 to more easily slide along track 15, but may be replaced in some embodiments of the invention by the use of a low-friction nut. Index nut 30, which is threaded tightly onto stud 13, has a series of notches around its perimeter for accepting a spring-loaded latch 32. Pressing on latch 32 and simultaneously rotating index nut 30 results in stud 13 rotating relative to entrapped nut 14. When the pressure on latch 32 is released, that latch engages one of a series of notches in index nut 30, preventing stud 13 from backing out of nut 14. Alignment tabs 34 fit into T-shaped slot 15 to prevent assembly 10 from rotating on board 16. Pressure plate 12 may have a rubber face to better grab the surface of board 16; with such construction, a weaker compression spring 19 may be used.

Figure 4:
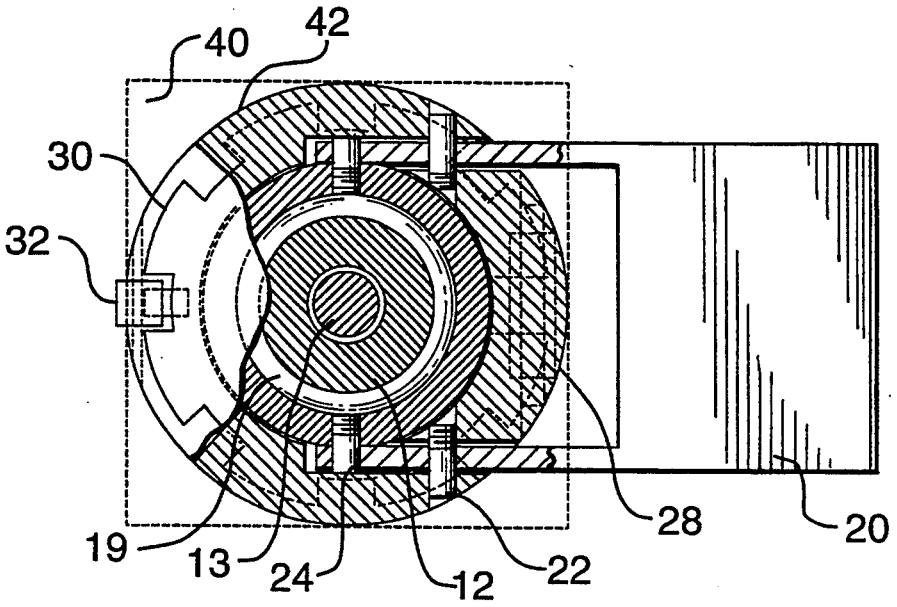
FIG. 4 is a partially-sectioned plan view of the first embodiment of the clutch assembly.

Housing 11 can be constructed of either aluminum or plastic, and in plan view could be either square or circular (see 40 and 42 in FIG. 4, respectively) or of other shape.

Figure 5:
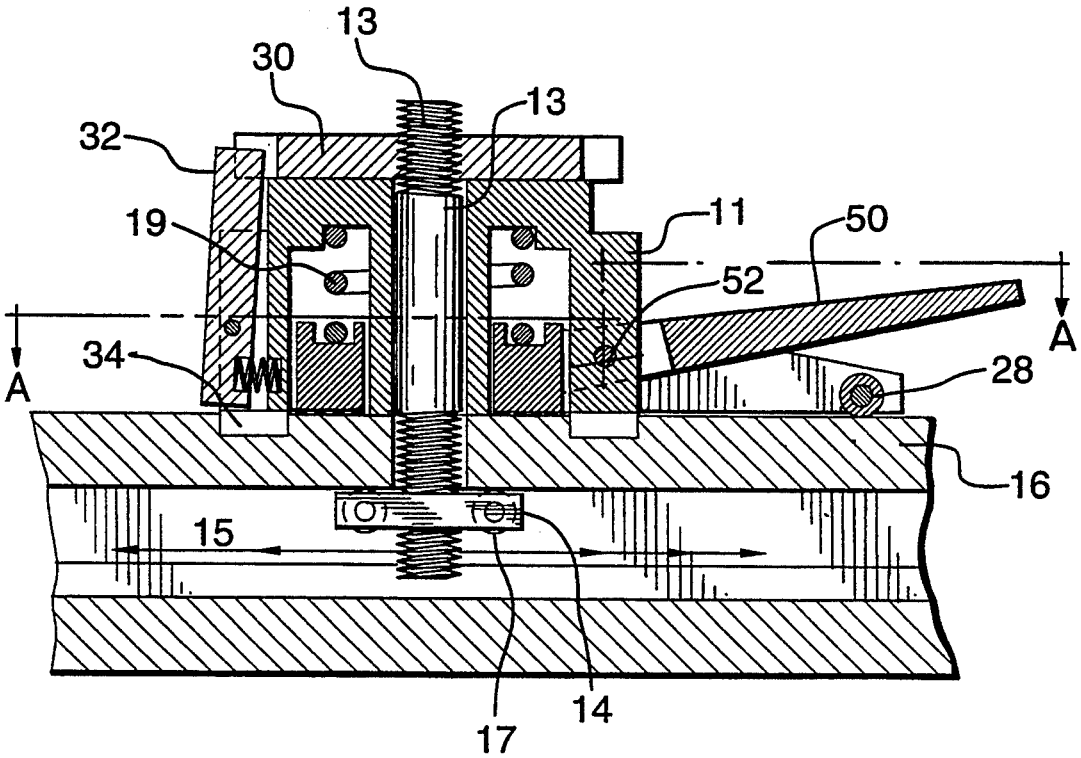
FIG. 5 is a sectioned side view of a second embodiment of the mast track clutch assembly.
Figure 6:
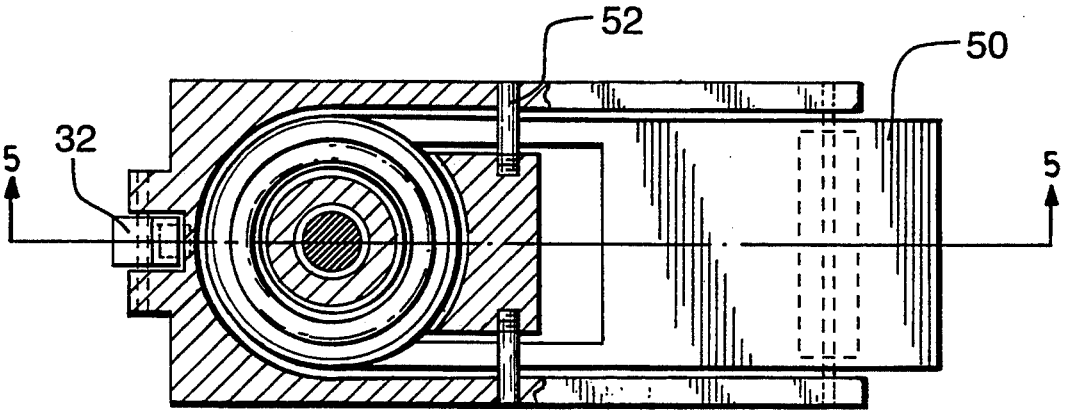
FIG. 6 is a partially-sectioned plan view of the second embodiment of the clutch assembly, the view being taken along the line "A"—"A" in FIG. 5.

It is conceivable that pedal 20 and pressure plate 12 may be made as a single rigid unit, instead of using forks 24 and pins 26. This modification is shown in FIGS. 5 and 6. The single rigid unit 50 rotates on a pin fulcrum 52, but the construction is otherwise similar to that described above.

It is also possible that the spring 19 may be replaced in some embodiments by a cam arrangement incorporated into the pedal 20 itself or attached to pedal 20, to tighten or loosen the latch assembly 10 on board 16. This arrangement can also be activated by foot pressure. Also possible is the replacement of spring 19 by a threaded device which can be turned easily by one's foot to tighten or loosen the device on board 16.

It will be appreciated that the above description relates to the preferred embodiment by way of example only. Many variations on the invention will be obvious to those knowledgeable in the field, and such obvious variations are within the scope of the invention as described and claimed, whether or not expressly described.

What is claimed as the invention is:

1. A mast track clutch assembly for attaching a mast to a sailboard having an internal longitudinally-extending slotted track, the assembly comprising:

(a) a stud member having one end adapted to extend into the slotted track, the other end of the stud member being adapted to receive the mast;

(b) a fastener adjustably positionable on the stud member;

(c) a housing slidably fitted on the stud member and positioned between the sailboard and the fastener;

(d) a plate biased away from the housing to press against the surface of the sailboard to prevent movement of the mast track clutch assembly relative to the sailboard; and, (e) a pedal pivotally mounted to the housing, the pedal having a first end extending outside of the housing and having a second end connected to the plate such that pressing the first end of the pedal acts against the bias to move the plate relative to the housing; whereby the longitudinal position of the mast relative to the sailboard may be adjusted while the pedal is pressed.

2. A mast track clutch assembly as in claim 1, wherein the second end of the pedal has a pair of forks which surround a pin mounted on the plate.

3. A mast track clutch assembly as in claim 1, wherein the pedal is integrally connected with the plate, such that the pedal and plate move together as a single unit.

4. A mast track clutch assembly as in claim 1, and also comprising a roller means mounted on the housing to facilitate longitudinal repositioning of the mast relative to the sailboard while the pedal is pressed.

5. A mast track clutch assembly as in claim 1, wherein the stud member is a threaded rod and wherein the fastener is a notched nut biased to assume one of a series of discrete angular positions relative to the housing, and wherein a portion of the housing is adapted to extend into the slotted track to prevent relative rotation between the housing and the sailboard.

6. A mast track clutch assembly as in claim 1, wherein the slotted track is generally T-shaped and defined by a first slot extending generally parallel to the surface of the sailboard and a second slot extending generally normal to the surface between the surface and a central position on the first slot, and wherein the stud member engages the slotted track by means of a second fastener positioned on the stud member and adapted to sit in the first slot, the second fastener being sized to prevent the stud member moving out of the second slot.

7. A mast track clutch assembly as in claim 1, wherein the slotted track is generally T-shaped and defined by a first slot extending generally parallel to the surface of the sailboard and a second slot extending generally normal to the surface between the surface and a central position on the first slot, and wherein the stud member engages the slotted track by means of a second fastener positioned on the stud member and adapted to sit in the first slot, the second fastener being sized to prevent the stud member moving out of the second slot, and wherein the stud member is a threaded rod and the second fastener is a nut, the assembly also comprising a roller means mounted on the nut to facilitate longitudinal repositioning of the mast relative to the sailboard when the pedal is pressed.

* * * * *